US007385528B2

(12) United States Patent
Gomez

(10) Patent No.: US 7,385,528 B2
(45) Date of Patent: Jun. 10, 2008

(54) COMBINATION CEILING FAN WITH LIGHT AND SOUND GENERATOR

(76) Inventor: Angel C. Gomez, 1925 S. Sultana Ave., Ontario, CA (US) 91761

( * ) Notice: Subject to any disclaimer, the term of this patent is extended or adjusted under 35 U.S.C. 154(b) by 240 days.

(21) Appl. No.: 11/256,570

(22) Filed: Oct. 24, 2005

(65) Prior Publication Data

US 2007/0057805 A1 Mar. 15, 2007

Related U.S. Application Data

(63) Continuation-in-part of application No. 29/231,777, filed on Sep. 12, 2005, now Pat. No. Des. 532,096.

(51) Int. Cl.
*G08B 21/00* (2006.01)

(52) U.S. Cl. ..... 340/946; 340/691.2; 340/540

(58) Field of Classification Search ..... 340/691.2, 340/933, 907, 545.3, 541, 540, 506, 505, 340/946, 965; 315/362, 294, 312; 250/222.1, 250/221; 342/118, 195, 28; 244/17.25, 244/6, 17.11, 17.27; 416/126, 129, 5
See application file for complete search history.

(56) References Cited

U.S. PATENT DOCUMENTS

| | | | | |
|---|---|---|---|---|
| 3,857,191 | A | 12/1974 | Sadorus | |
| 4,703,573 | A | 11/1987 | Montgomery et al. | |
| D295,430 | S | 4/1988 | Smith | |
| 4,791,741 | A | 12/1988 | Kondo | |
| 4,836,075 | A | 6/1989 | Armstrong | |
| D341,194 | S | 11/1993 | Reid et al. | |
| 5,359,374 | A | 10/1994 | Schwartz | |
| D359,553 | S | 6/1995 | His | |
| 5,511,944 | A * | 4/1996 | Ide et al. | 416/31 |
| D374,926 | S | 10/1996 | Sheh | |
| 6,107,930 | A * | 8/2000 | Behlke et al. | 340/825.19 |
| 6,118,386 | A * | 9/2000 | Yousif | 340/690 |
| 6,215,396 | B1 | 4/2001 | Script | |
| 6,297,746 | B1 * | 10/2001 | Nakazawa et al. | 340/825.69 |
| 6,448,924 | B1 * | 9/2002 | Hafer, Jr. | 342/28 |
| 6,542,078 | B2 | 4/2003 | Script et al. | |

* cited by examiner

*Primary Examiner*—Anh V. La
(74) *Attorney, Agent, or Firm*—Kirk A. Buhler; Buhler & Associates

(57) ABSTRACT

A ceiling fan with a light and sound generator is disclosed where the blades of the ceiling fan resemble the rotor blades of a helicopter. Under the blades of the ceiling fan a fixed or replaceable body of a helicopter is located or locatable. The blades of the helicopter may also be changeable to simulate different types of rotors for different helicopters. Control chains extend down from the body of the helicopter to resemble lanyards for repelling from the helicopter. The control chains provide control for fan speed, rotation direction, lighting, and may further include control of sounds that can be generated from the ceiling fan that may simulate commands from the pilot of a helicopter. A remote control can be provided to control the fan light and sound functions. A sensor for detecting the presence of a person in the room may also activate the sound generation.

20 Claims, 5 Drawing Sheets

COMBINATION CEILING FAN WITH LIGHT AND SOUND GENERATOR

CROSS REFERENCE TO RELATED APPLICATION

This application is a continuation-in-part of applicant's application Ser. No. 29/231,777 filed Sep. 12, 2005 now U.S. Pat. No. D,532,069.

DESCRIPTION

Field of the Invention

This invention relates to a ceiling fan with changeable blades, light and sound generator. More particularly, the present invention relates to a ceiling fan where the blades of the ceiling fan resemble the rotor blades of a helicopter. The body of a helicopter extends from under the blades of the ceiling fan. The control chains from the fan extend down from the body of the helicopter to resemble lanyards for repelling from the helicopter. The control chains further provide control of the fan speed, direction of rotation, lighting, and may further include control of sounds that can be generated from the ceiling fan that may simulate commands from the pilot of a helicopter. The sounds can also include "radio traffic" such as between the command pilot and gunners, co-pilots, crew chiefs, crew members, air traffic controller, as well as command and control from airborne, bunkered, forward air controllers and upper command staff. A sensor for detecting the presence of a person in the room may also activate the light and or sound generation. Variations of the blades and the body of the helicopter may be changeable to simulate different types of helicopters.

BACKGROUND OF THE INVENTION

Several design patents have been issued that resemble aircraft or parts of an aircraft in combination with a ceiling fan. Ceiling fans have been produced that allow for the removal or changing of fan blades to provide a different appearance. Products have also been patented that detect the presence of a person within a room and signal an alarm. Products have been patented that emit pre-recorded messages or statements. While all these products have been produced separately, none have been produced that provide a combination of all the components in a single product.

Examples of patents for aircraft in combination with a ceiling fan include design patents U.S. Pat. No. D295,430 issued to Smith on Apr. 26, 1988, U.S. Pat. No. D341,194 issued to Reid et al. on Nov. 9, 1993, U.S. Pat. No. D359,553 issued to His on Jun. 20, 1995 and U.S. pat. No. D374,926 issued to Sheh on Oct. 22, 1996. All of these patents are for the ornamental design of a ceiling fan with a helicopter body, but none of them offer the utility of lights, changeable number of blades, sounds, or motion detection.

Most ceiling fans are configured with replaceable or changeable blades to allow the fan to match the room. For the helicopter ceiling fan proposed various types of blades are possible including the removal of blades and replacing them with counter balancers that are used with some helicopters. The removal of a number of blades from ceiling fans is normally not a desirable feature because less airflow may result with the removal of blades. The rotors of the ceiling fan may also be configured to accommodate two, three, four, or six blades to match the helicopter type. Ceiling fans that are available today do not offer changeable blades with the functions of helicopter lighting, sounds, or motion detection.

Examples of motion detection devices include patents U.S. Pat. No. 6,215,396 issued to Script on Apr. 10, 2001 and U.S. Pat. No. 6,542,078 issued to Script et al. on Apr. 1, 2003. All of these patents are for stand alone or portable alarm systems that signal an alarm when a person or motion is detected. None of these patents are for the combination with a ceiling fan and further do not cover the combination of motion detection with a ceiling fan and sound production. They further do not cover the utility of lights, changeable number of blades, sounds, or motion detection.

Examples of solid-state sound generating devices include patents using a speech synthesizer chip such as the TMS5100, which was developed by Texas Instruments for educational uses. The electronic circuit contained on a semiconductor chip produces electrical impulses into simulated human speech with an electronically activated speaker electrically connected to the semiconductor chip for receiving said electrical impulses and converting them into sound simulating human speech. Patents with this or similar technology include patents U.S. Pat. No. 3,857,191 issued to Sadorus on Dec. 31, 1974, U.S. Pat. No. 4,703,573 issued to Montgomery et al. on Nov. 3, 1987, U.S. Pat. No. 4,791,741 issued to Kondo on Dec. 20, 1988 U.S. Pat. No. 4,836,075 issued to Armstrong on Jun. 6, 1989 and U.S. Pat. No. 5,359,374 issued to Schwartz on Oct. 25, 1994. All of these patents are for sound generating devices, but none of them are for a combination with a ceiling fan or a ceiling fan with lights, changeable number of blades or motion detection.

What is needed is a single product that offers changeable blades and bodies that simulate a helicopter with a ceiling fan with a sound-generating device. The ideal device would also allow the control chains that simulate lanyards that extend from the body of the helicopter. The device could also include a motion detection mechanism that can begin operation when a person is detected entering the room. The proposed application satisfies these requirements.

BRIEF SUMMARY OF THE INVENTION

It is an object of the proposed invention to provide a ceiling fan with the appearance of a helicopter hovering in a room. The ceiling fan includes the ability to replace or change the blades or number of blades of the ceiling fan to provide the appearance of different helicopters. The changes to the blades may include changing the number of blades from as few as two blades to as many as six blades. Additional attachments such as counter balancers can be included for use between the blades when only two blades are used. Attachments for wing tips weapon pylons or hardpoints may also be included with decals or other customizing components. Sound modification devices can further be included on the wings to provide an audible sound based upon the speed of the fan blades.

Another object of the invention is to provide a helicopter-ceiling fan with replaceable bodies. The bodies for the helicopter may be changeable in addition to the blades of the helicopter. The helicopter body can be configures to be detached from where the main rotor blades meet the body. This allows for the use of quick disconnects to be used for wires and helicopter body interchangeability and or replacement. The body can be configured in halves split down the sides, or split top and bottom. The interchangeable bodies may include a tail rotor or may include a second large rotor. The body includes armaments that can be attached to the body to simulate different types of weapons.

Another object of the invention is to provide a helicopter-ceiling fan with lanyards that control the fan speed direction and lights. The lanyards may be provided with figurines of solders repelling from the helicopter. The lanyards may also allow the setting or adjustment of the sounds that can be made from the helicopter.

Another object of the invention is to provide a helicopter-ceiling fan with motion detection. The motion detector can allow activation of sound and or lights when the movement of a person within the room is detected. The detection of a person may provide sound and or lights to be activated.

Another object of the invention is to provide a helicopter-ceiling fan with sound capability. The sound may include pre-recorded sounds of commands from the pilot or may allow the owner to record one or all of the messages. The messages may repeat at a pre-determined interval or may repeat in a pattern. The sound may operate with the motion detection such that the detection of motion begins the sound transmission.

Another object of the invention is to provide a remote control that can activate the functions some or all of the functions previously described.

Still another object of the invention is to provide a helicopter ceiling fan with lights. The lights may operate in a pre-determined pattern such as a searchlight, interior lights of the helicopter and or illumination of the room light. The lights may repeat at a pre-determined interval or may repeat in a pattern. The lights may operate with the motion detection such that the detection of motion begins a sequence of lighting operation.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
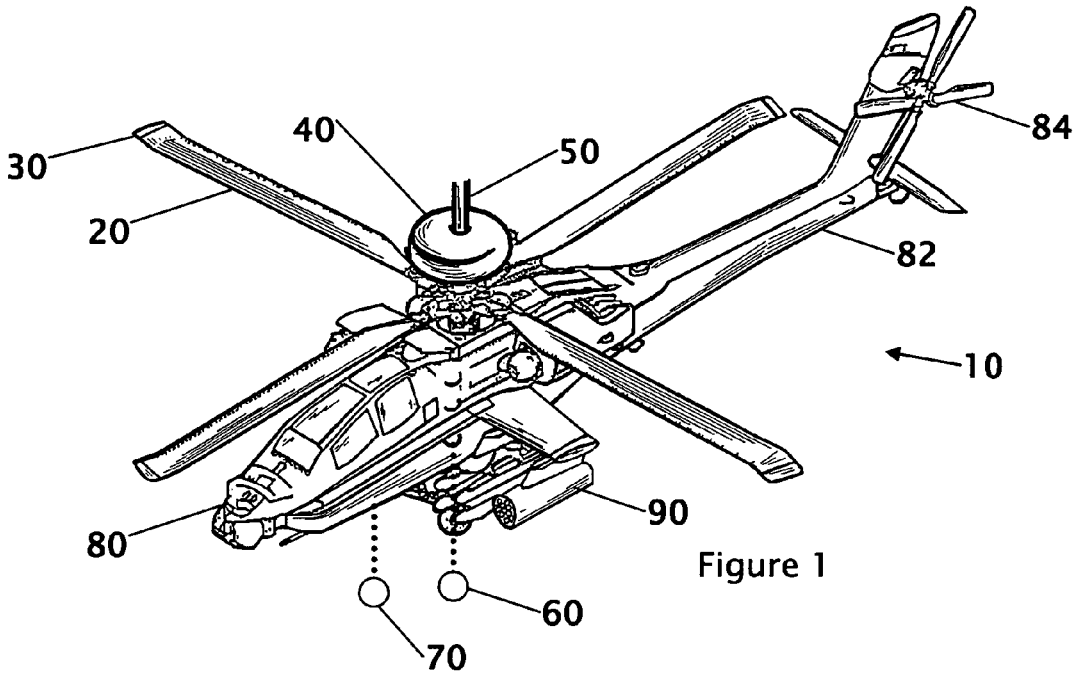
FIG. 1 is an isometric view of an Apache helicopter ceiling fan.
Figure 2:
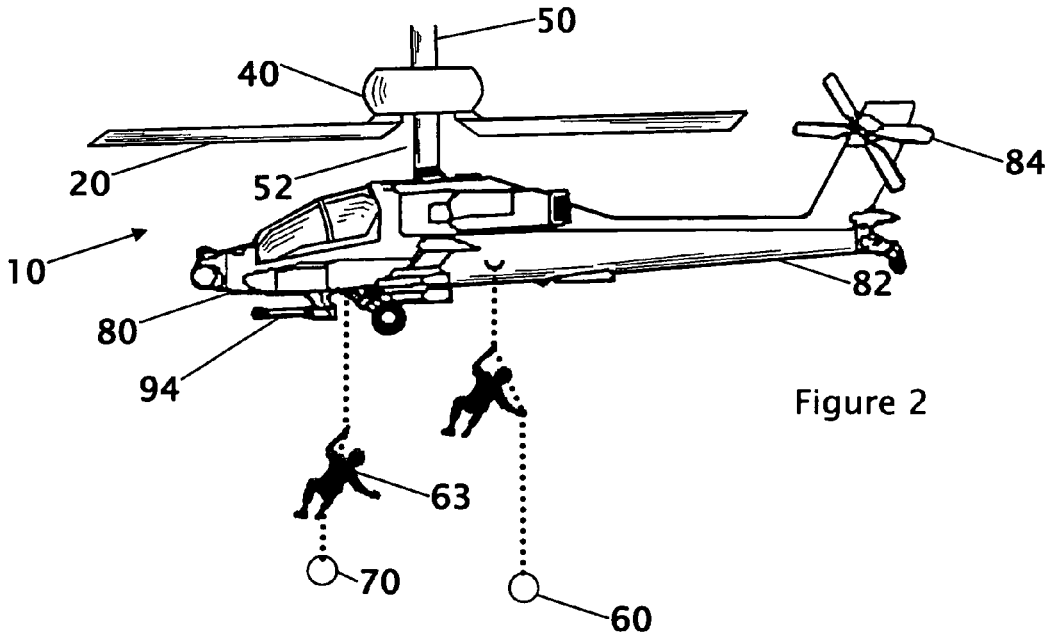
FIG. 2 is a side view of an Apache helicopter ceiling fan
Figure 3:
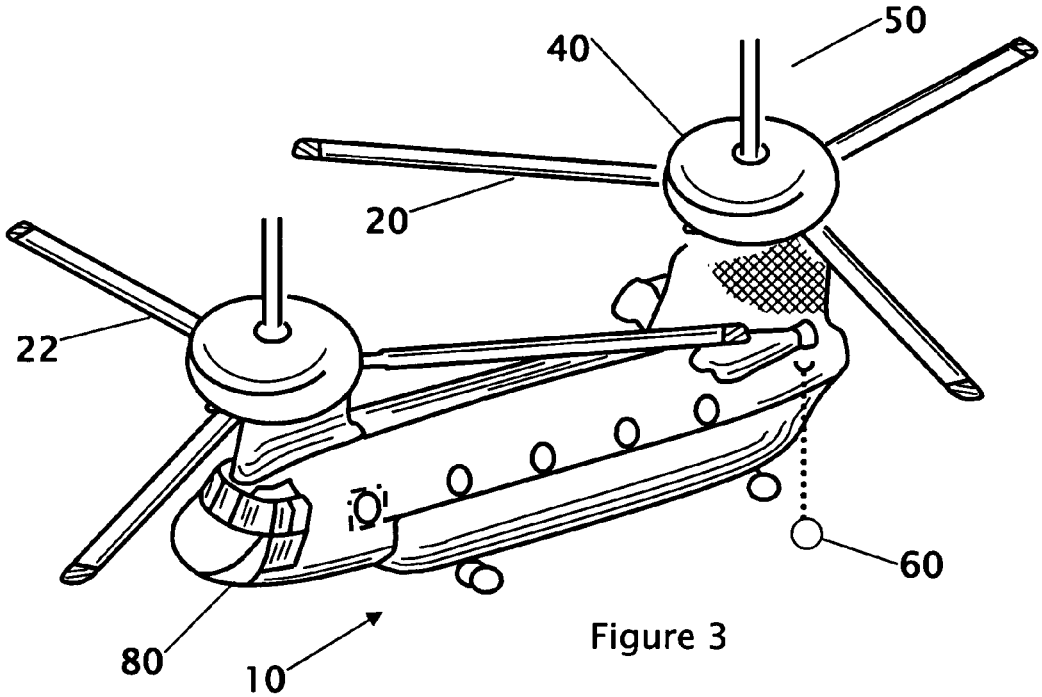
FIG. 3 is an isometric view of a Sea Knight helicopter-ceiling fan.
Figure 4:
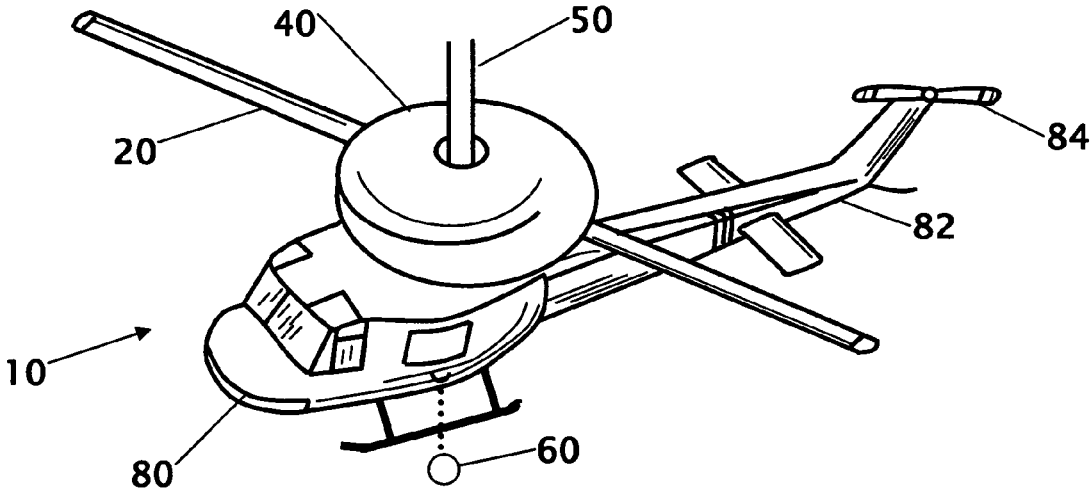
FIG. 4 is an isometric view of a Huey helicopter-ceiling fan.
Figure 5:
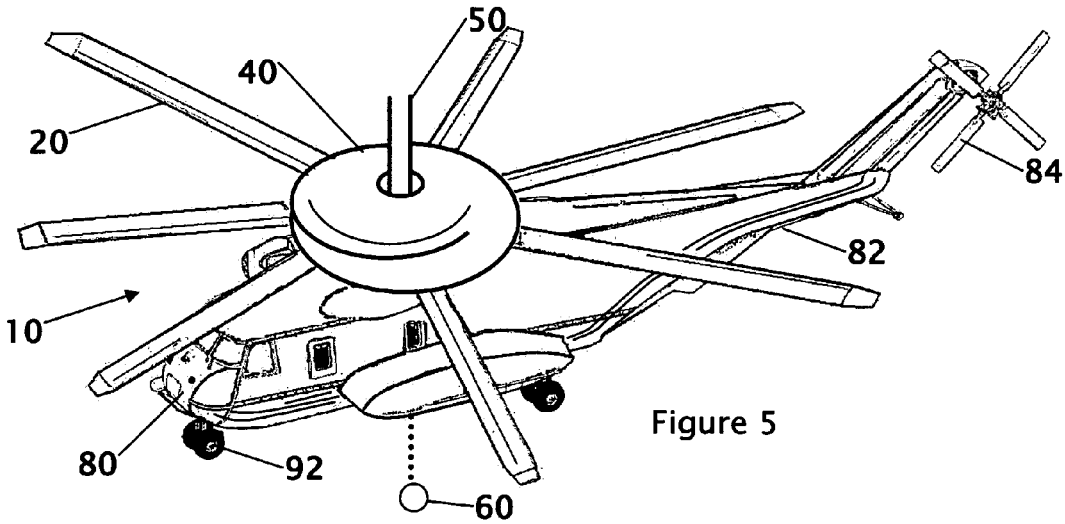
FIG. 5 is an isometric view of a Sea Dragon helicopter-ceiling fan.

Referring to FIGS. 1-5 show different body and rotor configurations for the helicopter ceiling fan. FIG. 1 is isometric view of an Apache helicopter ceiling fan 10. FIG. 2 is a side view of an Apache helicopter ceiling fan 10. FIG. 3 is an isometric view of a Sea Knight helicopter-ceiling fan 10. FIG. 4 is an isometric view of a Huey helicopter-ceiling fan 10. FIG. 5 is an isometric view of a Sea Dragon helicopter-ceiling fan 10. These figures show four different types of helicopter bodies with rotors from two to six blades. The showing of these four different body and blade configurations is reflective of a sample of the configurations that are contemplated. A list of helicopters contemplated include but is not limited to Super Cobra, Apache, Chinook, Huey, Super Stallion, Seahawk, Pave Hawk, Pave Low IIIE, Comanche, Sea Ranger, Blackhawk, Little Bird", Sea Knight, Sea Stallion, Sea King, Dolphin, Sea Dragon, Kiowa Warrior, Seahawk and Iroquois. In addition to the various body styles there can be further customization to include law enforcement, fire departments, civilian transport, corporate and federal agencies. These may be either pre-fabricated onto the body, or can be decals or colors that can be added to a stock body.

These figures show the various components in embodiments that have been constructed or contemplated. The bodies and or blades of the helicopters can be changed or re-configured to provide a different look to the ceiling fan. It is contemplated that the body of the helicopter 80 be fabricated in two or more pieces that are split vertically such that they can be brought together around the area under the blades of the ceiling fan. Other configurations are contemplated that split the body 80 of the helicopter in the area under the blades of the ceiling fan such that the back section of the helicopter 82 can be joined with the front section of the helicopter. The helicopter-ceiling fan 10 is configured from a standard or customized ceiling fan. The blades 20 of the ceiling fan can be configured with two, three, four, or six blades that can be added to the rotor of the ceiling fan. The blade and mounting options on the ceiling fan motor will be described in more detail with FIGS. 7-10.

The motor 40 of the ceiling fan is shown in these figures suspended from a down pipe 50. While it is shown with a down pipe, the ceiling fan can be attached directly to the ceiling. The motor housing 40 can be the standard motor housing that is manufactured for the fan. It is contemplated that the cowling for the motor can be decorated with camouflage paint or can be decorated with images of helicopters or instructions on assembling or changing the configuration of the helicopter.

In addition to configuring the helicopter ceiling fan with different bodies and blades, a variety of armaments can be added to the body of the helicopter to simulate rockets 90, wheels 92, guns 94, missiles, fuel tanks or other items that can be added to a helicopter. Decals and other items have been contemplated as additional items that can be added to the helicopter. Items can also be added to the wing and wing tips 30 to provide a greater variety of appearances to the helicopter.

In most configurations a tail rotor 84 is shown at the end of the tail section. The tail rotor can be made to rotate with the main blades of the helicopter, or can be configured such that airflow that is generated from the ceiling fan provides rotation to the tail rotor. In the configuration shown in FIG. 3, the Sea Knight has two main rotors. Only on of the rotors is shown powered in this configuration. It is contemplated that another configuration could allow both rotors to be powered. Because this helicopter uses two partially overlapping blades, the bladed are staggered (one above the other to allow them to spin without hitting each other. In one embodiment the airflow from the powered rotor 80 provides sufficient air movement that the second main rotor 22 turns.

Control lines for the fan are shown as lanyards or repelling lines that extend down from the helicopter ceiling fan.

In the preferred embodiment one of the control lines operates the fan speed 60, and a second control line operates lights 70. A figure such as a person repelling 63 or hardware such as guns, supplies or packages can be included on the control lines or as the control end. The direction of the fan blades may be controlled by a third control line, a switch located on or within the body of the helicopter, or may exist under the body of the helicopter. All of these controls may also operate a sound mechanism that gives commands based upon changes made to the control lines. The sound light and fan speed functions can also be controlled by a remote control that can activate the functions some or all of the functions described. The remote can also operate specific sounds such as guns, "radio traffic" as between the command pilot and gunners, co-pilots, crew chiefs, crew members, air traffic controller, as well as command and control from airborne, bunkered, forward air controllers, and upper command staff. Within the body of the helicopter a motion sensor can detect movement and can begin a sequence of lights, sounds and or motion from the ceiling fan. The helicopter may include one or multiple lights that may include a search light located on the outside of the helicopter, internal cockpit lights within the body of the helicopter, or room lights that illuminate the entire room. These functions will be described in more detail with FIG. 6. The repelling lines are shown with a simple ball located at the end of the repelling line. In the preferred embodiment the repelling line has a solder or other personnel attached. It is further contemplated that the lanyard may have a piece of equipment connected such as supplies, guns or other hardware.

Figure 6:
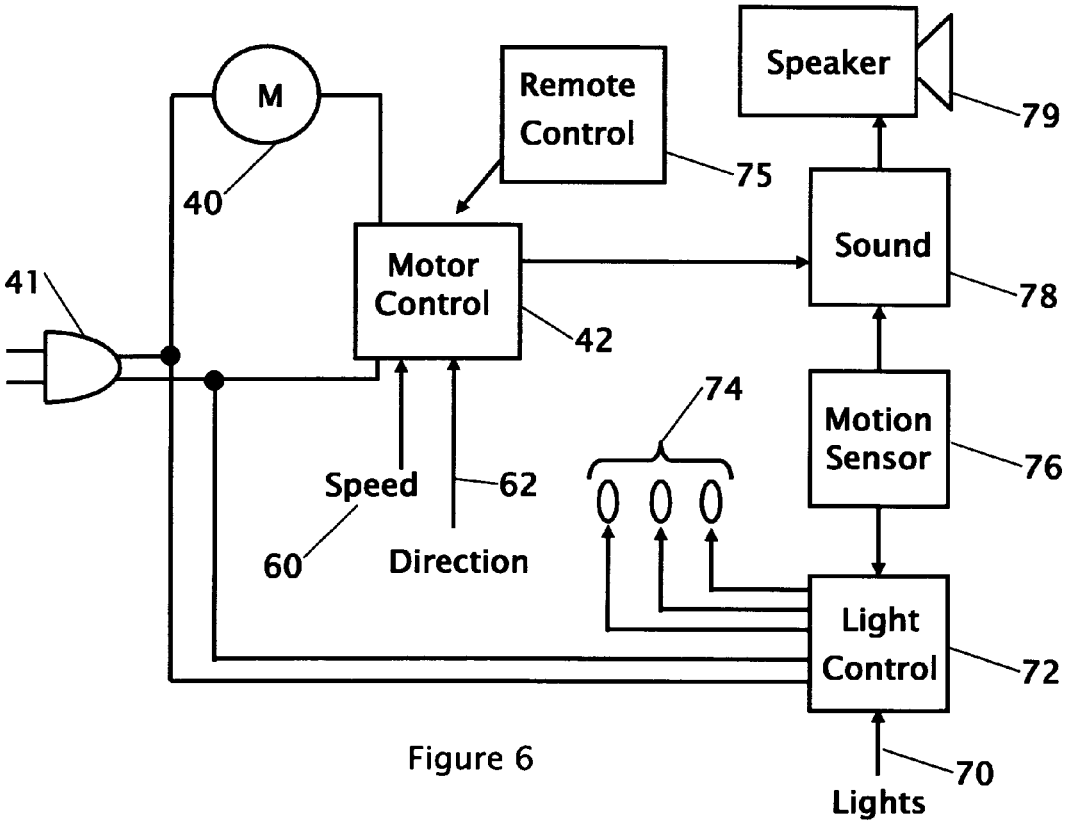
FIG. 6 is a block diagram of the electronic functions of the helicopter-ceiling fan.

FIG. 6 is a block diagram of the electronic functions of the helicopter-ceiling fan. Power is supplied to the helicopter ceiling fan from an external outlet 41, house wiring or other source. The power is supplied to the motor control 42, the light control 72 and the motion sensor 76. Switches or controls 60 and 62 control the speed and direction of the fan motor. The sound light and fan speed functions can also be controlled by a remote control 75 that can activate the functions some or all of the functions described. In the preferred embodiment the speed control 60 from a lanyard that extends from the motor, and the direction control 62 is with a switch. In the preferred embodiment, the motor control 42 is in communication with a sound generator device 78, and when a change is made to the speed or direction of the motor a sequence of sounds and or lights begin. The sequence may vary based upon the change being made. As an example, when the fan is started a light 74 within the helicopter may turn on and the helicopter may say, "Clear for engine start." The voice may then perform a starting checklist as the fan blades begin to turn. If the fan motor 40 is being turned off the voice may say "Mission complete, clear to return to base." and a searchlight 74 outside the helicopter may turn on. A room light 94 may be operated from a lanyard 70 connected to the ceiling fan. The control of the lights may all be from a light control 72 that interact with the motor control 42, sound chip 78, and or a motion sensor 76.

A motion sensor can be included with the helicopter-ceiling fan that detects the presence or motion within the room. When motion is detected the cockpit of the helicopter may illuminate, the searchlight may turn on and a voice may say, "Tracking unidentified target request permission to fire." The voice/sound chip may be any variety capable of playing sounds or speech. The sounds may be from a set sequence based upon the actions of a person, or may be random. The sounds can also include "radio traffic" such as between the command pilot and gunners, co-pilots, crew chiefs, crew members, air traffic controller, as well as command and control from airborne, bunkered, forward air controllers and upper command staff. In the preferred embodiment the sound is from a speech synthesizer chip such as the TMS5100, which was developed by Texas Instruments for educational uses. The electronic circuit contained on a semiconductor chip produces electrical impulses into simulated human speech or sound with an electronically activated speaker 79 electrically connected to the semiconductor chip for receiving said electrical impulses and converting them into sound simulating human speech.

Figure 7:
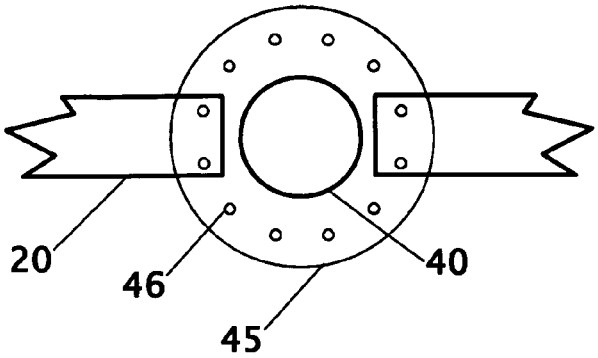
FIG. 7 shows a two-blade configuration for the helicopter-ceiling fan.
Figure 8:
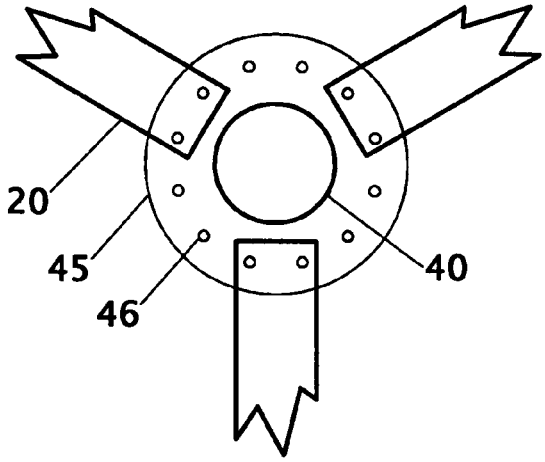
FIG. 8 shows a two-blade configuration for the helicopter-ceiling fan.
Figure 9:
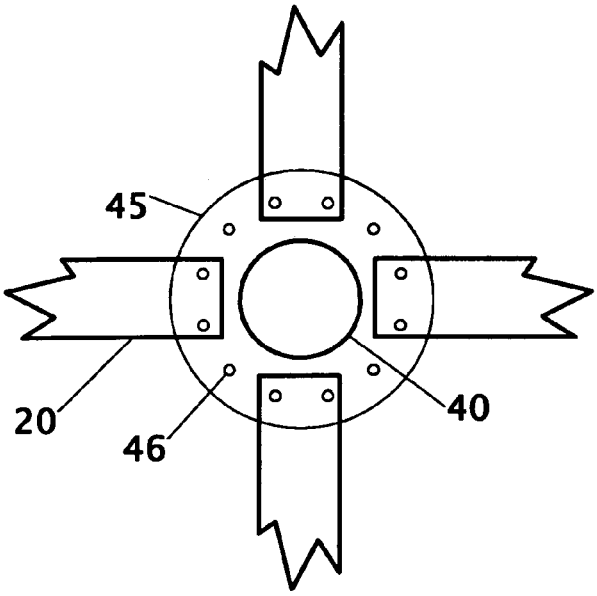
FIG. 9 shows a two-blade configuration for the helicopter-ceiling fan.
Figure 10:
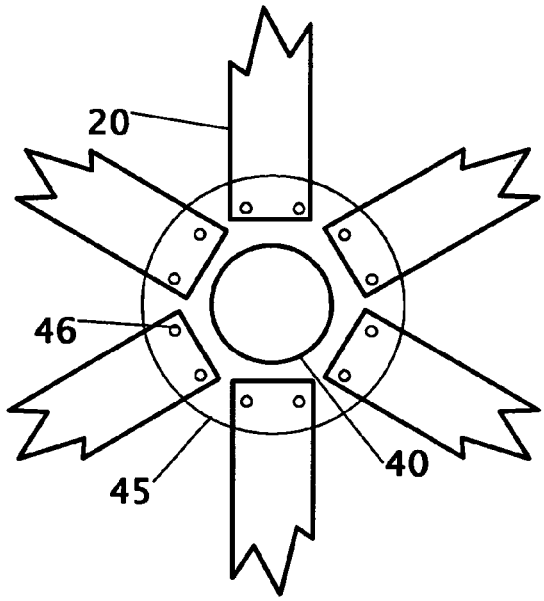
FIG. 10 shows a two-blade configuration for the helicopter-ceiling fan.

FIGS. 7-10 show various blade configurations that can be attached to the motor. These configurations include a two-blade configuration as shown in FIG. 7, a three-blade configuration as shown in FIG. 8, a four-blade configuration as shown in FIG. 9, and a six-blade configuration as shown in FIG. 10. The rotor plate 45 is specially designed and configured to accept a variable number of blades. This configuration with the fan blades allows a single rotor plate 45 to accept from two to six blades. While it may also be possible to use a single fan blade and to configure the blades such that the motor is not balanced, configurations that would not provide a balanced fan would also not be a part of helicopter blade configuration. The unique spacing of the blade mounting holes 46 allow for the multiple fan blade 20 connections. The remainder of the motor and electronics 40 are shown for reference. The two-blade configuration can be found on the Huey, three blades can be found on the Chinook, four blades can be found on the Apache, and six blades can be found on the Sea Dragon. Counter balances can be located on unused hole locations.

Figure 11:
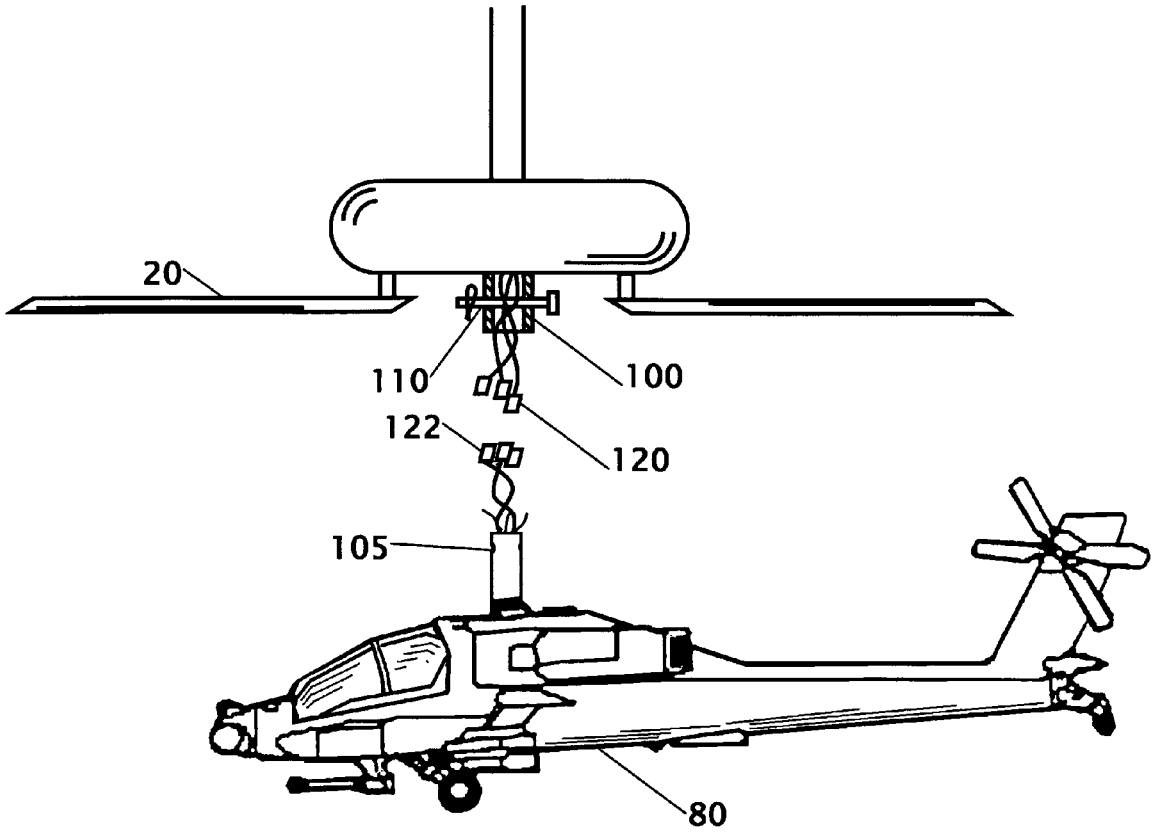
FIG. 11 shows one embodiment of attaching a changeable helicopter body to the ceiling fan.

FIG. 11 shows one embodiment of attaching a changeable helicopter body to the ceiling fan. This shows how a helicopter body 80 can be configured to be detachable from where the main rotor blades 20 meet the body. This allows for the use of quick disconnects to be used for wires and helicopter body interchangeability and or replacement. The quick disconnects shown 120 and 122 in this figure provide one connection for each wire to account for each of the functions of lights, sound and fan speed, but some embodiments may a multiple conductor connector. The down tube 100 is configured with a through hole where the mating tube from the helicopter body includes a similar through hole 105 where a pin 110 can be placed through the two tubes securing the helicopter body to the ceiling fan with a cotter pin or similar fastening means.

Thus, specific embodiments and applications for a helicopter ceiling fan has been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A combination helicopter ceiling fan comprising:

a ceiling mountable fan with a body of a helicopter mounted under the blades of the ceiling fan; and a motion detection device within the body of the helicopter that operates with a helicopter light and or helicopter sound playback device within the body of the helicopter such that when motion is detected the motion detection device begins a playback of sound and or light.

2. The combination helicopter ceiling fan from claim 1 wherein the number of blades of the ceiling fan can be varied from two to six blades.

3. The combination helicopter ceiling fan from claim 1 wherein the body of the helicopter can be changeable to provide a different appearance of the helicopter.

4. The combination helicopter-ceiling fan from claim 1 wherein the blades further include the ability to attach blade altering components to alter the appearance and or shape of the blades.

5. The combination helicopter ceiling fan from claim 1 wherein the motion detection utilizes thermal sound or motion sensors to determine the presence or motion within the room.

6. The combination helicopter ceiling fan from claim 1 wherein the light includes a room light, searchlight attached to the body of the helicopter lights internal to the body of the helicopter or a combination thereof.

7. The combination helicopter ceiling fan from claim 1 wherein the sound playback device provides pre-recorded sounds that simulate instructions or commands that might come from a helicopter pilot.

8. A combination helicopter ceiling fan comprising:

a ceiling mountable fan with a body of a helicopter mounted under the blades of the ceiling fan;

control lanyards for control of the fan direction and speed that extend from the ceiling fan;

a sound playback device within the body of the helicopter that operates with the ceiling fan such that when the speed or direction of the fan blades are altered the sound playback device begins to playback at least one sound sequence based upon the actions of the user or from a random set of pre-recorded sounds.

9. The combination helicopter ceiling fan from claim 8 wherein the number of blades of the ceiling fan can be varied from two to six blades.

10. The combination helicopter ceiling fan from claim 8 wherein the body of the helicopter can be changeable to provide a different appearance of the helicopter.

11. The combination helicopter-ceiling fan from claim 8 wherein the blades further include the ability to attach blade altering components to alter the appearance and or shape of the blades.

12. The combination helicopter ceiling fan from claim 8 wherein the lanyards further include control of the light from the helicopter and or ceiling fan.

13. The combination helicopter ceiling fan from claim 8 wherein the sound playback device provides pre-recorded sounds that simulate instructions or commands that might come from a helicopter pilot.

14. A combination helicopter ceiling fan comprising:

a ceiling mountable fan with a body of a helicopter mounted under the blades of the ceiling fan, where the number and configuration of blades on the ceiling fan can be altered to increase or decrease the number of blades depending on the type of the helicopter used.

15. The combination helicopter ceiling fan from claim 14 wherein the body of the helicopter can be changeable to provide a different appearance of the helicopter.

16. The combination helicopter-ceiling fan from claim 14 wherein the blades further include the ability to attach blade altering components to alter the appearance and or shape of the blades.

17. The combination helicopter ceiling fan from claim 14 that further includes motion detection means that can active sounds and or lights.

18. The motion detection means from claim 17 wherein the sounds and or lights provides at least one pre-recorded sounds and or lighting sequence that might come from using the helicopter.

19. The combination helicopter ceiling fan from claim 14 that further includes control lanyards that extend from the ceiling fan that are used to control lights and or sound based upon the actions of the user or from a random set of pre-recorded sounds and lighting.

20. The control lanyards from claim 19 wherein the control lights and or sound provides at least one pre-recorded sounds and or lighting sequence that might come from a helicopter pilot.

* * * * *